United States Patent [19]

Rude et al.

[11] Patent Number: 4,623,012

[45] Date of Patent: Nov. 18, 1986

[54] HEADRAIL HARDWARE FOR HANGING WINDOW COVERINGS

[75] Inventors: Edward T. Rude, Fairfield; Jules Nisenson, Stamford; Martin Waine, Riverside, all of Conn.

[73] Assignee: General Clutch Corporation, New York, N.Y.

[21] Appl. No.: 565,709

[22] Filed: Dec. 27, 1983

[51] Int. Cl.[4] ..... A47H 1/00

[52] U.S. Cl. ..... 160/243; 160/84 R; 160/171

[58] Field of Search ..... 160/84 R, 171, 243

[56] References Cited

U.S. PATENT DOCUMENTS

| | | | |
|---|---|---|---|
| 1,068,306 | 7/1913 | Boughton | 160/243 |
| 1,342,527 | 6/1920 | Cahill | 160/171 |
| 1,848,742 | 3/1932 | Oulsman et al. | 160/171 |
| 1,894,833 | 1/1933 | Ruby et al. | 160/171 |
| 2,250,106 | 7/1941 | Lorentzen | 160/171 |
| 2,520,629 | 8/1950 | Esposito | 160/171 |
| 3,246,685 | 4/1966 | Anderson et al. | 160/243 |
| 3,352,349 | 11/1967 | Hennequin | 160/171 |
| 3,487,875 | 1/1970 | Shukat et al. | 160/84 R |

FOREIGN PATENT DOCUMENTS

| | | | |
|---|---|---|---|
| 986529 | 3/1965 | United Kingdom | 160/171 |

*Primary Examiner*—J. Franklin Foss
*Assistant Examiner*—David M. Purol
*Attorney, Agent, or Firm*—Gottlieb, Rackman & Reisman

[57] ABSTRACT

A capstan based system for pulling and accumulating the pull-cords used to lift hanging window coverings from their bottoms. A cylindrical capstan is supported in bearings so that it is free to rotate and move axially. A splined connection to a holding device permits controlled rotation and locking of the capstan. Each of one or more cords is attached to the capstan by means of a clip which can be easily positioned to adjust the position and length of its cord. As the capstan is turned, the cords wind onto the capstan in a single layer due to the camming action of a specially configured camming surface. The capstan begins to move laterally when sufficient friction has developed between the capstan and the cord which has been wound onto it. This provides space for the cord to wind onto the capstan in a single layer. During unwinding of the cord, a guiding surface, over which the cord moves, pulls the capstan back toward its original position. The camming and guiding surfaces can be made symmetric so that bidirectional operation of the system is possible.

18 Claims, 14 Drawing Figures

FIG. 4
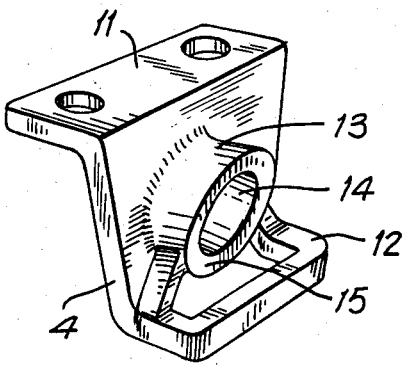
FIG. 5
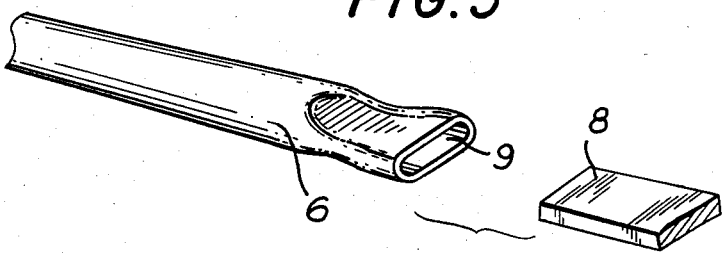
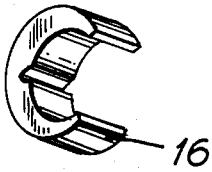
FIG. 6

HEADRAIL HARDWARE FOR HANGING WINDOW COVERINGS

This invention relates to the operating hardware for headrails used with hanging window coverings made to be raised and lowered from the bottom. Such coverings, of which woven wood blinds and venetian blinds are examples, are usually lifted from the bottom of the blind by cords which pass over pulleys and on which the user pulls directly, without any mechanical advantage. When such a blind is fully extended, the entire weight of the blind is supported by the attachment to the headrail, the structural member at the top of the blind by which the blind is mounted. The lift cords, used to raise the blind, are slack at full extension. As the blind is raised, beginning with the bottom, an increasing portion of the blind's weight is supported by the lift cords. When the blind is fully raised, all of its weight, except that near the headrail, is supported by the lift cords. Since these blinds often weigh ten pounds, and sometimes as much as thirty pounds, the force necessary to raise them can be more than a small person or a child can manage. Even for one strong enough to raise the blinds, it can be quite uncomfortable to the hands.

In addition, the cord locking mechanism used to maintain the blinds in an elevated position requires that the operator pull the cords to one side and release them in order to engage the lock. This process sometimes results in only one of the several cords being engaged so that the blind falls lower on one side and hangs unevenly. To lower the blind the user must first lift the blind slightly to release the cord lock and then, while holding the cords in the correct position so as not to re-engage the lock, carefully allow the cords to move up. This requires that the user support the weight of the blind while it is being lowered. If the cords are released too rapidly, the blind can fall noisily and unevenly to the bottom of the window. Sometimes, while a blind is being lowered, one of the cords will contact the locking mechanism which will catch either that cord alone, causing the blind to lower on one side only, or it will catch all of the cords causing the blind to be latched in that position and no longer free to be lowered.

Also disadvantageous is the fact that, when the blinds are fully raised, the cords often reach the floor where they lie in an an unattractive and inconvenient fashion. A further disadvantage to the present day hardware is that the cords are quickly worn by the cord locking mechanisms which hold the blinds at elevated positions. Cord wear is caused mainly because the cord locking mechanism, which performs its function by pinching the cords between a sharp gripper piece and an anvil, often at the same spot on the cords, results in badly worn spots or broken cords. Furthermore, the cords become soiled from the user's hands and, since the operator pulls on the same cords which lift the blind, the entire blind must be restrung when the cords become dirty. Restringing usually requires the services of a professional.

The installation of woven wood blinds and other types of blinds which are lifted from the bottom by two or more cords is complicated by the requirement that all the cords be the same length if the blind is to hang properly. In present day hardware the installer must adjust the length of each cord at the knot which terminates that cord to an attachment near the bottom of the blind. The cords lie along the inside surface of the blind, facing the window, so that the adjustment is further complicated in that they are hard to reach and also in that the blind is not hanging freely while the adjustment is being made. It is, therefore, not uncommon for the adjustment to be made several times before the blind is finally hung correctly. More than one adjustment will often be necessary because the cords stretch under load.

A wide variety of patents have been granted to those who have, over a period of a century, attempted to provide satisfactory solutions to some of the difficulties mentioned above. Among these are many which use some type of roll-up mechanism to contain the lifting cords within the headrail itself. Devices that contain the cords within the headrail ordinarily employ some sort of capstan onto which the cords (or, in older blinds, tapes) are wound as the blind is raised. Usually the capstan is rotated by a separate cord, often in the form of a loop which rides over a pulley. This pulley is then connected to the capstan so that pulling on one side or the other of the cord loop rotates the capstan, raising or lowering the blind.

The capstan approach in headrail design has the advantage that the lift cords suffer much less wear, abrasion, and soiling than in presently utilized designs. No cord lock is used, and the operator handles only the cord loop, not the lift cords. The cord loop is easily removable for cleaning or replacement. A holding device, operating on the capstan rather than on the lift cords, is used to maintain the position of the capstan while the blind is elevated.

Designs incorporating capstans require some mechanism to cause the capstan to traverse as the blind is raised or lowered so that the lift cords will wind in a closely spaced, single layer onto the capstan. Also, if the lift cords are allowed to wind one layer on another, then the mechanical advantage of the lift system decreases as the diameter of the accumulated, wound cord spool increases. Since this decrease in mechanical advantage accompanies an increase in supported weight and, therefore, an increase in the pull necessary to further raise the blind, this arrangement is not desirable. If one, but not all, of the cords is allowed to overwind any of the previously wound cord, then the overwinding cord will raise its side of the blind at a greater rate than the cords which do not overwind because the overwinding cord will be accumulated onto a surface with a larger diameter. If the close spacing is not maintained, then additional capstan length will be required to lift the blind. Prior art designs have included gear racks and lead screws to coordinate the motion of the cpastan with the winding of the lift cords so that a closely spaced single layer is achieved.

It is an object of the present invention to provide a lifting mechanism which overcomes the above-mentioned difficulties in design, installation, and operation.

In particular, it is an object of the present invention to provide a lifting system with mechanical advantage whose lift cords can be kept within the headrail and whose headrail will, nevertheless, be small in size and require fewer parts than prior art systems.

It is a further object of this invention to provide a lifting system whose lift cords can easily be adjusted to the correct length either at the time of installation or at any time thereafter when there is need to do so.

It is a further object of the present invention to provide a lifting system in which the cords suffer minimal wear and do not become easily soiled by frequent contact with the hands of the user, and in which the cords can easily be cleaned or replaced and adjusted to the proper length.

It is a further object of the present invention to provide a lifting system operated by a separate loop of cord or bead chain which can be easily replaced when it is soiled without the necessity of restringing the entire blind.

To these ends the present invention provides a capstan onto which the lift cords wind as well as a holding device which, in the preferred embodiment, is bi-directional, to control raising and lowering of the blind. This allows the lift cords to be separate from the operating cord which can, then, be easily removed for cleaning or replacement. Novel cord grips are used which allow extremely simple installation and adjustment of the lift cords. As the operating cord is pulled the holding device, or clutch, is released and the capstan is rotated, winding the lift cords onto the surface of the capstan. Each lift cord, as it winds onto the capstan, contacts a stationary camming surface resulting in a lateral force on the lift cord which deflects it away from the camming surface. When there is sufficient friction between the lift cord and the capstan, this deflection of the cord will cause the capstan to move laterally, providing space for the cord to continue to wind onto the capstan in a single layer. Without this camming action to move the capstan, the cord would eventually be forced into a multilayered wind. Multilayer winding has the disadvantages previously discussed. The camming surface can be shaped so that, regardless of the direction in which the cord is wound onto the capstan, the deflection of the cord will be in the same direction. Making the system bi-directional in this fashion eliminates the need for a stop at the full extension of the blind. If the system cannot properly handle cord for either direction of wind, then a stop must be included to prevent operation in the wrong direction.

Further objects, features and advantages of our invention will become apparent upon consideration of the following detailed description in conjunction with the drawings, in which:

FIG. 4 shows the bearing, bracket, and cord guide assembly of the lifting mechanism;

FIG. 5 shows the spline joint between the capstan and the clutch shaft of the lifting mechanism;

FIG. 6 shows a cord grip; and

Figure 3:
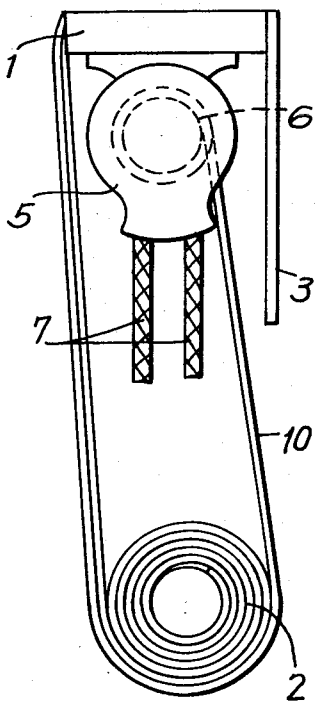
FIG. 3 is an end view of a different blind which rolls up.
Figure 2:
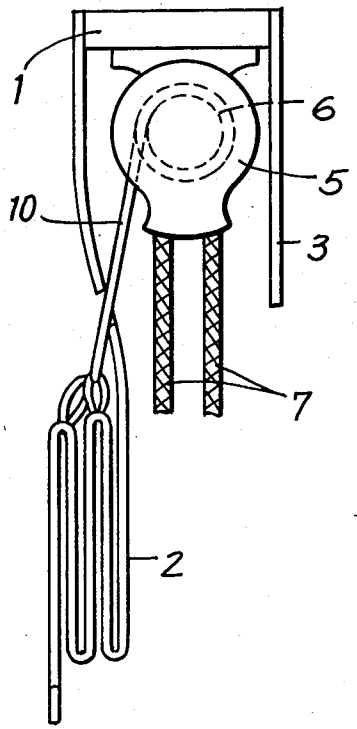
FIG. 2 is an end view of a woven wood blind used with the lifting mechanism of FIG. 1.

Two examples of window coverings which can use the present invention advantageously are depicted, but others will be obvious to those skilled in the art. FIG. 2 shows a Roman fold blind, and FIG. 3 a roll-up configuration, both of which can use the lift system of the invention.

Figure 1:
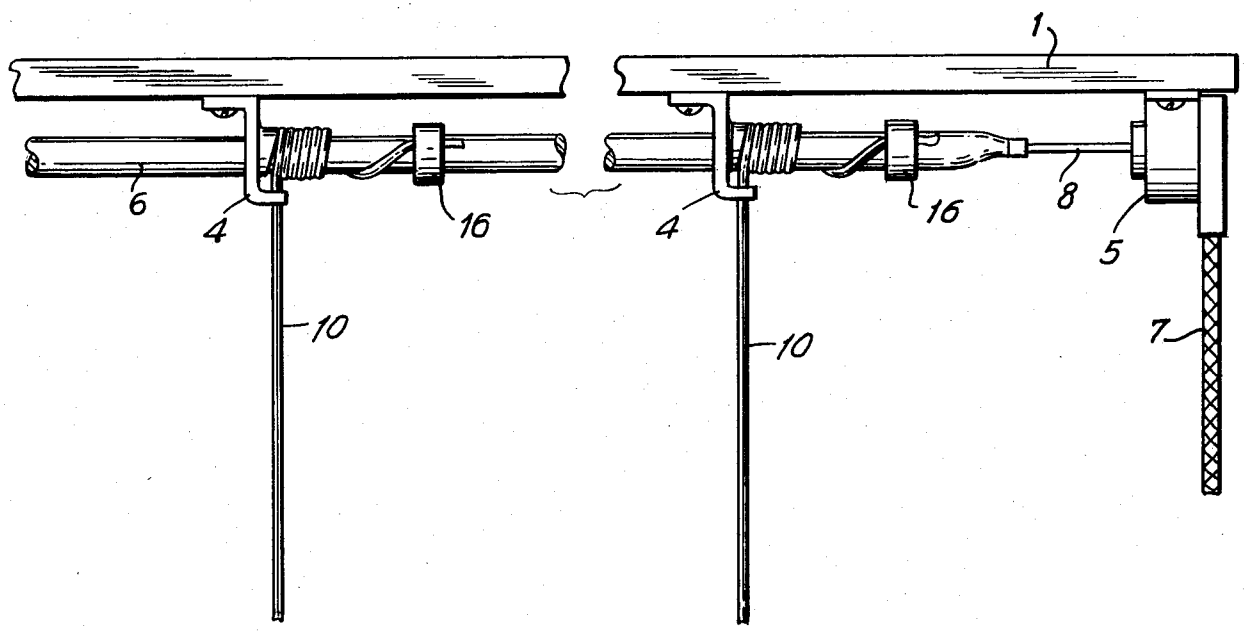
FIG. 1 is a side elevation view of an illustrative embodiment of the lifting mechanism of the invention.

The general organization of the system can be seen in FIG. 1. The hardware is mounted to headrail 1 which is, ordinarily, made of wood but which could as well be metal or plastic. Blind 2 and valence 3 (FIGS. 2 and 3) are mounted to the headrail. Installation is usually done by attaching the headrail to brackets or to the ceiling. The hardware which is mounted to the headrail consists of brackets 4, shown in FIGS. 1 and 4, along the clutch 5 shown in FIG. 1. The preferred embodiment utilizes two or more brackets although a single bracket could be used in some lifting configurations. In the preferred embodiment, bracket 4, shown separately in FIG. 4, is a molded plastic part having features as follows: mounting flange 11, cord guide 12, capstan bearing 13 with opening 14, and camming surface 15.

The holding device in the preferred embodiment, clutch 5, is of the type disclosed in U.S. Pat. No. 4,372,432. It permits rotation when cord loop 7 is moved, but is locked when the cord is released. Output shaft 8 transmits the motion of clutch 5 to capstan 6. Bearing 13 of bracket 4 supports capstan 6 while permitting it to rotate freely. The upper end of each lift cord 10 is positioned on capstan 6 by a clip 16, shown separately in FIG. 6, and in position on the capstan in FIG. 1. Referring to FIG. 5, opening 9 in one end of capstan 6 is so formed as to slide easily over output shaft 8 producing, thereby, a spline connection between the two pieces that permits torque to be transmitted between them while still allowing relatively free lateral movement of capstan 6. Other types of holding devices can be used in place of the one in the preferred embodiment, however, provisions for back-locking and for a stop at the bottom may be necessary if the device is uni-directional.

Figure 7A:
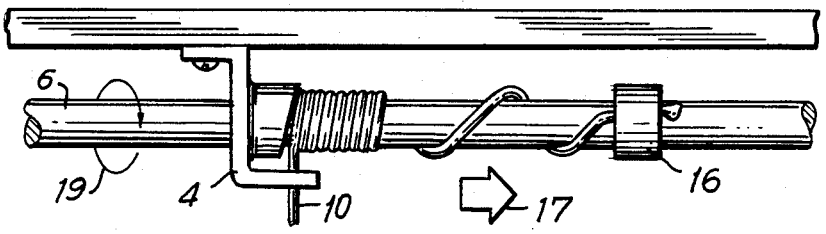
FIGS. 7A through 7H are a sequence of views of the illustrative embodiment of the invention in various stages of its operation (with bracket 4 of FIG. 7B being shown in section).
Figure 7B:
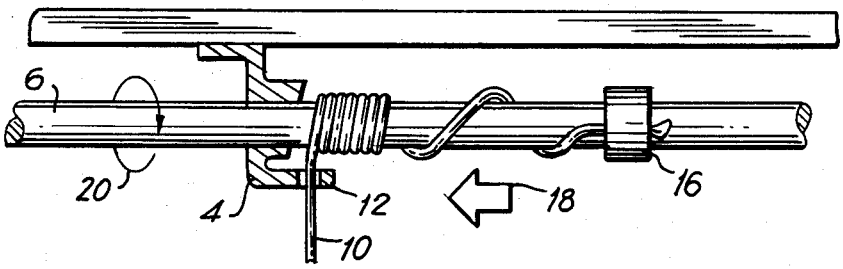
Figure 7C:
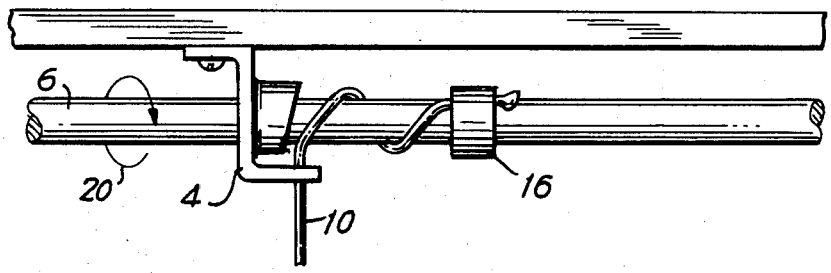
Figure 7D:
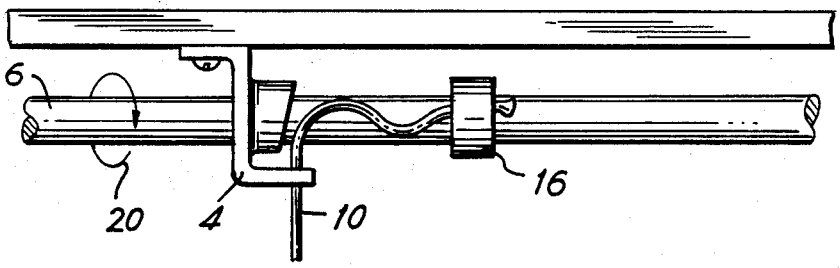
Figure 7E:
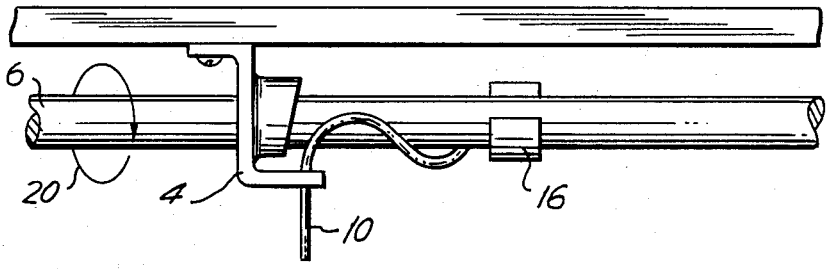
Figure 7F:
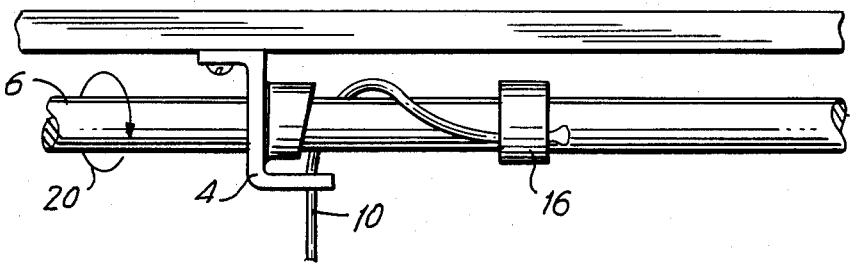
Figure 7G:
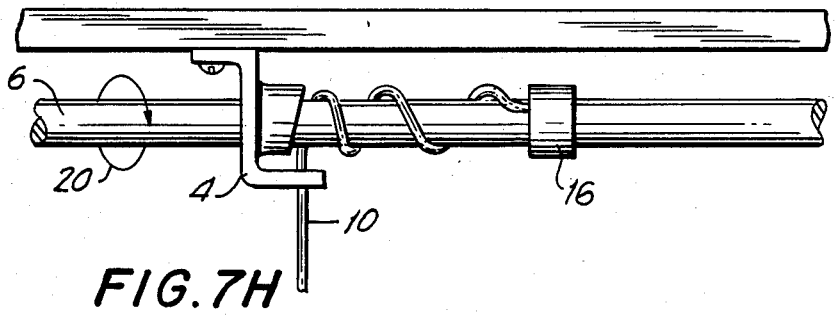
Figure 7H:
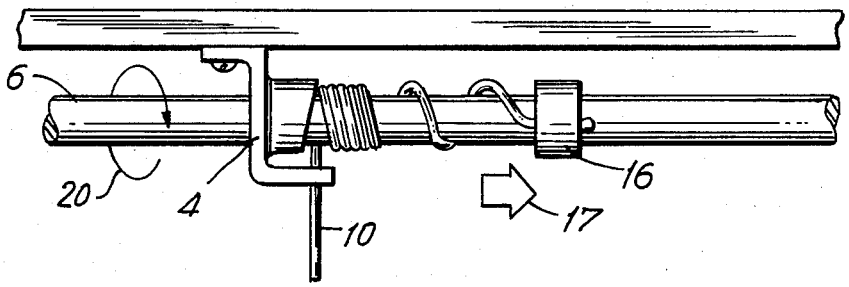

FIGS. 7A through 7H depict various stages of the system's operation in sequence. The blind is raised and lowered by pulling on one side or the other of cord loop 7. As capstan 6 rotates, lift cords 10 are wound around it, raising the blind from the bottom. After a few turns of cord have been wound onto capstan 6, some of the blind's weight is being supported by the lift cords and the last turns of cord tighten on the capstan. Bracket 4 has an important function in addition to that of supporting capstan 6. As shown in FIG. 4, camming surface 15 is slanted so that a lateral force is exerted on the respective cord as it is wound onto the capstan. The lateral force, due to the action of camming surface 15 on the cord as it is wound onto capstan 6 in the direction of arrow 19 of FIG. 7A, then causes capstan 6 to move as indicated by arrow 17 in FIG. 7A. Space is provided in this way for additional cord to be wound onto the capstan. During lowering of the blind, as cord is being unwound from capstan 6 which now moves in the direction of arrow 20 of FIG. 7B, the cord bends about cord guide 12 exerting, thereby, a force in the opposite direction on the capstan, moving the capstan as indicated by arrow 18 in FIG. 7B. FIG. 7C shows the lift cord almost fully unwound from the capstan. FIG. 7D shows the cord fully unwound as rotation continues in the same direction. FIG. 7E shows the cord starting to wind in the other direction onto the capstan. FIG. 7F shows one turn wrapped onto the capstan in the new direction, and FIG. 7G shows three turns on the capstan. At some point sufficient friction will have developed between the cord and the capstan so that camming action will begin as shown in FIG. 7H. This causes the movement of capstan 6 in the direction of arrow 17 of FIG. 7H. Camming surface 15 is symmetric with respect to the direction of rotation of the capstan tube so that the capstan will wind cord properly for either direction of rotation. The requirement for a stop at the full extension of the blind is eliminated by this symmetry. If a stop were to be used, then it would have to be incorporated into the capstan and be properly positioned with respect to the remainder of the hardware. This cumbersome positioning requirement is eliminated by the use of the bi-directional system of the preferred embodiment of our invention.

The tension in lift cords 10 is greatest where they first contact the capstan and it decreases in the direction of the clip due to the friction between the cords and the tube. Near the clip the tension remains quite low, even when the cords are fully wound onto the capstan and the entire weight of the blind is being supported by the cords. This permits the clips to hold the cords with a rather small gripping force. Adjustment of the individual lift cords is performed while the blind is fully extended and there is no tension on the lift cords. The adjustment is accomplished by sliding the appropriate clip 16 on the capstan. Assembly of the headrail system is greatly simplified by the use of the clips. Prior art attachment methods required drilling holes in the capstan at predetermined locations which requires much more careful planning and layout. Adjustments in the lengths of individual lift cords are much more difficult to make if the cords are attached to the capstan through predrilled holes.

Wider blinds may require more than two lift cords in which case an additional bracket with cord guide and clip would be provided for each additional lift cord. As many lift cords can be used as are required to properly support the blind.

A Ratchet mechanism, gear reduction device, or frictional brake can be used as the holding device. Any unidirectional holding device will operate the mechanism. However, a stop will then be required at the full extension of the blind to prevent the lift cords from being fully unwound and then rewound onto the capstan in the opposite direction, since a uni-directional holding device will not maintain the position of the blind when the operating cord is no longer being pulled if the cords are wound in the wrong direction on the capstan. A stop which limits the capstan to that rotation required to fully extend the blind solves the problem. The addition of a stop requires additional parts, and any stop mechanism must be adjusted to operate at just the position corresponding to the full extension of the blind. The use of a bi-directional holding device, such as one of the type described in U.S. Pat. No. 4,372,432, eliminates the need for a stop since the blind can be held in position no matter which direction the cords are wound onto the capstan.

The lift system described above has application also in situations where no lifting is required. The system could be used in any circumstance in which motion is to be produced be the winding of a cord, rope, or other flexible tension member, and where at least some amount of tension will be maintained at all times.

Although the invention has been described with reference to particular embodiments, it is to be understood that these embodiments are merely illustrative of the application of the principles of the invention. Numerous modifications may be made therein and other arrangements may be devised withoug departing from the spirit and scope of the invention.

We claim:

1. A lifting mechanism comprising a cylinder; bracket means to support said cylinder; rotation means; said cylinder being slideably connected to said rotation means to allow torque to be transmitted between said rotation means and said cylinder while still permitting lateral movement of said cylinder relative to said rotation means; a camming surface; a lift cord attached to said cylinder and bearing against said camming surface responsive to rotation of said cylinder for wrapping itself around said cylinder and for alone moving said cylinder in a first lateral direction at a rate determined solely by the pitch of said camming surface and the diameter of said lift cord; and a guiding surface disposed so that rotation of said cylinder so as to unwrap said lift cord from said cylinder causes said lift cord, while unwrapping, to bear against said guiding surface to produce a component of tension in said lift cord, parallel to the axis of said cylinder, for alone causing said cylinder to move in a second, opposite lateral direction.

2. A lifting mechanism in accordance with claim 1 further including clip means made of spring material shaped to snap more than half way around said cylinder, for slideably securing said lift cord to said cylinder to prevent movement of the end of said lift cord during normal operation and to permit occasional adjustment of the length of said lift cord by lateral movement of said clip.

3. A lifting mechanism in accordance with claim 1 wherein said camming surface is on said bracket means.

4. A lifting mechanism in accordance with claim 1 wherein said guiding surface is on said bracket means.

5. A lifting mechanism in accordance with claim 1 wherein said camming surface and said guiding surface are both on said bracket means.

6. A lifting mechanism in accordance with claim 1 wherein said camming surface is configured such that rotation of said cylinder so as to wrap said lift cord in either direction causes said lift cord to bear against said camming surface to cause said cylinder to move in said first lateral direction.

7. A lifting mechanism in accordance with claim 6 wherein said guiding surface is configured such that unwrapping of said lift cord from said cylinder in either direction causes said lift cord to bear against said guiding surface to cause said cylinder to move in said second, opposite lateral direction.

8. A lifting mechanism comprising a cylinder; bracket means to support said cylinder; rotation means; said cylinder being slideably connected to said rotation means to allow torque to be transmitted between said rotation means and said cylinder while still permitting lateral movement of said cylinder relative to said rotation means; two or more camming surfaces; one lift cord attached to said cylinder and bearing against each of said camming surfaces responsive to rotation of said cylinder for wrapping themselves around said cylinder and for alone moving said cylinder in a first lateral direction at a rate determined solely by the pitches of said camming surfaces and the diameters of said lift cords; and two or more guiding surfaces so disposed in relation to said lift cords that rotation of said cylinder so as to unwrap said lift cords from said cylinder causes each of said lift cords, while unwrapping to bear against a respective guiding surface to produce a component of tension in said lift cord, parallel to the axis of said cylinder for alone causing said cylinder to move in a second, opposite lateral direction.

9. A lifting mechanism in accordance with claim 8 further including a clip means for each of said lift cords, made of spring material shaped to snap more than half way around said cylinder, for slideably securing said lift cord to said cylinder to prevent movement of the end of said lift cord during normal operation and to permit occasional adjustment of the length of said lift cord by lateral movement of said clip.

10. A lifting mechanism in accordance with claim 8 wherein said camming surfaces are on said bracket means.

11. A lifting mechanism in accordance with claim 8 wherein said guiding surfaces are on said bracket means.

12. A lifting mechanism in accordance with claim 8 wherein said camming surfaces and said guiding surfaces are both on said bracket means.

13. A lifting mechanism in accordance with claim 8 wherein said camming surfaces are configured such that rotation of said cylinder so as to wrap said lift cords in either direction causes said lift cords to bear against said camming surfaces to cause said cylinder to move in said first lateral direction.

14. A lifting mechanism in accordance with claim 13 wherein said guiding surfaces are configured such that unwrapping of said lift cords from said cylinder in either direction causes said lift cords to bear against said guiding surfaces to cause said cylinder to move in said second, opposite lateral direction.

15. A pulling mechanism comprising a cylinder; bracket means to support said cylinder; rotation means; said cylinder being slideably connected to said rotation means to allow torque to be transmitted between said rotation means and said cylinder while still permitting translational movement of said cylinder relative to said rotation means; a camming surface; a cord attached to said cylinder and bearing against said camming surface such responsive to rotation of said cylinder for wrapping itself around said cylinder and for alone moving said cylinder in a first translational direction at a rate determined by the pitch of said camming surface and the diameter of said lift cord; and a guiding surface disposed so that rotation of said cylinder so as to unwrap said cord from said cylinder in a first translational direction at a rate determined by the pitch of said camming surface and the diameter of said lift cord; and a guiding surface disposed so that rotation of said cylinder so as to unwrap said cord from said cylinder causes said cord, while unwrapping, to bear against said guiding surface to produce a component of tension in said lift cord, parallel to the axis of said cylinder, for alone causing said cylinder to move in a second, opposite translational direction.

16. A pulling mechanism in accordance with claim 15 wherein said camming surface is configured such that rotation of said cylinder so as to wrap said cord in either direction causes said cord to bear against said camming surface to cause said cylinder to move in said first translational direction.

17. A pulling mechanism in accordance with claim 16 wherein said guiding surface is configured such that unwrapping of said cord from said cylinder in either direction causes said cord to bear against said guiding surface to cause said cylinder to move in said second, opposite translational direction.

18. A pulling mechanism in accordance with claim 15 wherein said guiding surface is configured such that unwrapping of said cord from said cylinder in either direction causes said cord to bear against said guiding surface to cause said cylinder to move in said second, opposite translational direction.

* * * * *